US009809950B2

(12) United States Patent
Zimmerman et al.

(10) Patent No.: US 9,809,950 B2
(45) Date of Patent: Nov. 7, 2017

(54) TWO STAGE MOLDBOARD RAIL CLEANER

(71) Applicant: DEERE & COMPANY, Moline, IL (US)

(72) Inventors: Scott W. Zimmerman, Peosta, IA (US); Dustin T. Staade, Dubuque, IA (US); Joseph Fochs, Dubuque, IA (US)

(73) Assignee: Deere & Company, Moline, IL (US)

( * ) Notice: Subject to any disclaimer, the term of this patent is extended or adjusted under 35 U.S.C. 154(b) by 74 days.

(21) Appl. No.: 14/933,070

(22) Filed: Nov. 5, 2015

(65) Prior Publication Data

US 2017/0130422 A1 May 11, 2017

(51) Int. Cl.

| | |
|---|---|
| ***E02F 3/00*** | (2006.01) |
| ***E02F 3/815*** | (2006.01) |
| ***E02F 3/76*** | (2006.01) |
| ***E02F 3/36*** | (2006.01) |

(52) U.S. Cl.

CPC ..... *E02F 3/8152* (2013.01); *E02F 3/3604* (2013.01); *E02F 3/7663* (2013.01)

(58) Field of Classification Search

CPC ..... A01B 15/02; A01B 31/00; E02F 3/7654; E02F 3/8157; E02F 3/815; E02F 3/80; E02F 3/7672; E02F 3/8152; E02F 3/7681; E02F 3/7677; E02F 3/7663; E02F 3/3604; F16C 29/0609; F16C 29/065; F16C 29/086; F16C 29/0633; F16C 33/6622

USPC ..... 37/266, 281; 172/684.5, 781, 795, 811; 384/15, 45

See application file for complete search history.

(56) References Cited

U.S. PATENT DOCUMENTS

| | | | | |
|---|---|---|---|---|
| 2,799,099 | A | 7/1957 | Leliter | |
| 3,465,829 | A * | 9/1969 | McCarthy | A01B 31/00 172/667 |
| 3,501,157 | A | 3/1970 | Doutt | |
| 4,683,959 | A * | 8/1987 | Clemens | E02F 3/8157 172/667 |
| 5,076,370 | A * | 12/1991 | Stubben | A01B 15/02 172/684.5 |
| 5,547,285 | A * | 8/1996 | Hutzel | B23Q 1/26 384/15 |
| 7,607,383 | B2 | 10/2009 | Nagel | |
| 7,650,949 | B1 * | 1/2010 | Horstman | E02F 3/7672 172/781 |
| 7,736,059 | B2 * | 6/2010 | Chen | F16C 29/086 384/15 |
| 7,789,564 | B2 * | 9/2010 | Keller | F16C 29/0645 384/15 |
| 8,316,956 | B2 | 11/2012 | Horstman et al. | |

(Continued)

OTHER PUBLICATIONS

Hydrowype; Hydrowype Rod Scrapers; Webpage; Last accessed Feb. 4, 2016 at "https://gadjets-public.sharepoint.com/".

*Primary Examiner* — Robert Pezzuto

(74) *Attorney, Agent, or Firm* — Taft Stettinius & Hollister, LLP; Stephen F. Rost

(57) ABSTRACT

A moldboard rail cleaner for removing debris from a rail of a work machine having a tilt frame housing defining a first cavity. The work machine has a wear insert positioned within the first cavity and adapted to slide along the rail as the rail moves along a rail axis. Further, a sub-housing may be coupled to the tilt frame housing and define a second cavity. Finally, a wiper is disposed at least partially within the second cavity, the sub-housing configured to bias the wiper into contact with the rail.

19 Claims, 5 Drawing Sheets

(56) References Cited

U.S. PATENT DOCUMENTS

| | | | | |
|---|---|---|---|---|
| 8,696,204 | B2 * | 4/2014 | Ooga | F16C 29/086 277/345 |
| 8,840,115 | B2 | 9/2014 | Johnson et al. | |
| 2002/0170724 | A1 * | 11/2002 | McGugan | E02F 3/8157 172/781 |
| 2006/0070758 | A1 * | 4/2006 | Ryan | E02F 3/7654 172/781 |

* cited by examiner

TWO STAGE MOLDBOARD RAIL CLEANER

FIELD OF THE DISCLOSURE

The present disclosure relates to a moldboard rail, and in particular, to a moldboard rail cleaner.

BACKGROUND OF THE DISCLOSURE

Many work machines, such as a motor grader, utilize a moldboard or blade to manipulate an underlying surface as the work machine travels thereon. To provide increased utility to the work machine, the moldboard can slide axially to several positions along a moldboard axis. Typically, a hydraulic actuator moves the moldboard along the moldboard axis to a location desired by a user. The moldboard is often held in alignment with the moldboard axis by one or more linear rails that are coupled to the moldboard on at least one surface and slidably coupled to the work machine through a tilt-frame housing along a different surface. Further, one or more wear inserts are often positioned in the tilt-frame housing to provide a contact surface for the linear rail as the moldboard moves along the moldboard axis. The pressure at which the wear insert presses against the contact surface is adjustable to hold the moldboard in alignment with a tilt frame assembly while allowing the linear rail to slide thereon.

Over time, the wear inserts become worn down along the contact surface. More specifically, debris is often positioned along the contact surface between the wear insert and the linear rail. As the moldboard is moved from one position along the moldboard axis to another, the linear rail slides along the contact surface and the debris disposed between the linear rail and the wear insert will cause the wear insert to degrade. The degradation of the wear insert may require monitoring, adjustment, or replacement of the wear insert to ensure optimal alignment of the moldboard relative to the work machine overall.

SUMMARY

One embodiment is a moldboard rail cleaner for removing debris from a rail of a work machine, comprising a tilt frame housing defining a first cavity; a wear insert positioned within the first cavity and adapted to slide along the rail as the rail moves along a rail axis; a sub-housing coupled to the tilt frame housing and defining a second cavity; and a wiper disposed at least partially within the second cavity, the sub-housing configured to bias the wiper into contact with the rail.

Another embodiment is a moldboard rail cleaning apparatus for a work machine, comprising a moldboard coupled to a moldboard rail, the moldboard rail defining a rail axis; a tilt frame housing coupled to the work machine and defining a first cavity, a first side, and a second side; a wear insert disposed within the first cavity; a sub-housing coupled to the first or second side of the tilt frame housing and defining a sub-housing cavity; and a wiper disposed at least partially within the sub-housing cavity; wherein, the wiper defines a wiping surface that contacts a portion of the moldboard rail.

Yet another embodiment is a work machine, comprising a frame coupled to one or more wheels; an implement coupled to the frame for performing a work operation, the implement defining an implement axis; at least one rail coupled to the implement; at least one housing having a first side and a second side and coupling the rail to the frame; at least one sub-housing coupled to the housing and defining a second cavity; at least one wiper disposed partially within the second cavity; and an actuator coupled between the frame and the implement, the actuator adapted to move the implement along the implement axis; wherein, when the implement moves along the implement axis, the sub-housing is adapted to remove any coarse particulate disposed along the rail and the wiper is adapted to remove any fine particulate disposed along the rail.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
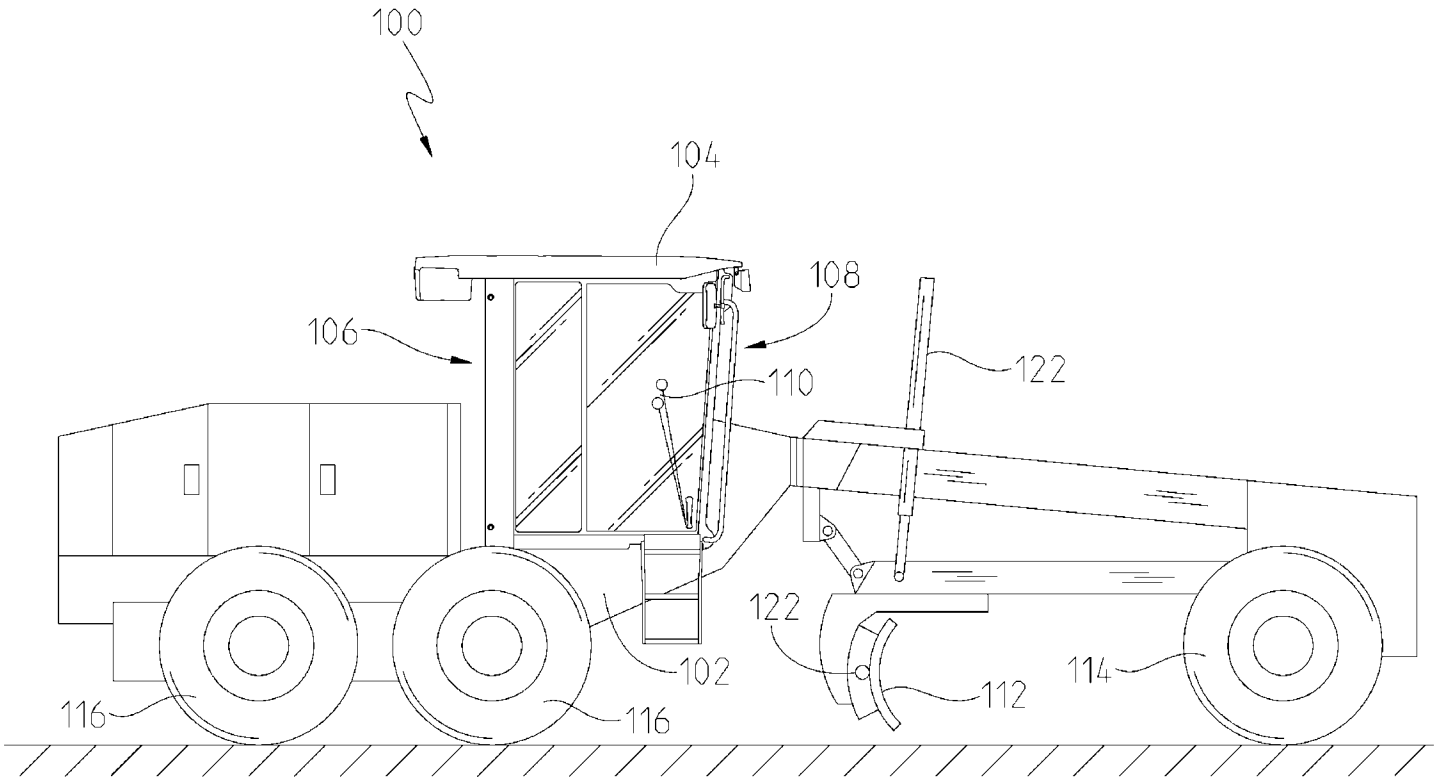
FIG. 1 is a side view of a work machine.

Referring to FIG. 1, a work machine 100 is shown. In one embodiment, the work machine 100 may be a motor grader. However, this disclosure is not limited to such a machine. Rather, the teachings of this disclosure may be applicable to any work machine including, but not limited to, any work machine that utilizes a moldboard 112.

The work machine 100 in FIG. 1 has a chassis 102 coupled to a front set of wheels 114 and a rear set of wheels 116. Also coupled to the chassis 102 may be a cabin 104 that has a back portion 106 and a front portion 108. The cabin 104 may also define an interior region where a user may control the work machine 100 with a plurality of controls 110.

In one aspect of the present disclosure, the plurality of controls may be manipulated by the user to control the location of the moldboard 112. The plurality of controls 110 may be switches, levers, push buttons, a steering wheel, and any other similar control mechanism and this disclosure is not limited to any one. In the nonexclusive embodiment of FIG. 1, the moldboard 112 may be repositionable relative to the work machine through a plurality of actuators 122 coupled between the moldboard and the chassis 102. However, this disclosure is not limited to such an embodiment. This disclosure is equally applicable to any type of implement that may be part of a work machine and require control by the user. For example, any agricultural, construction, or forestry machine may utilize the teachings of this disclosure.

Figure 2:
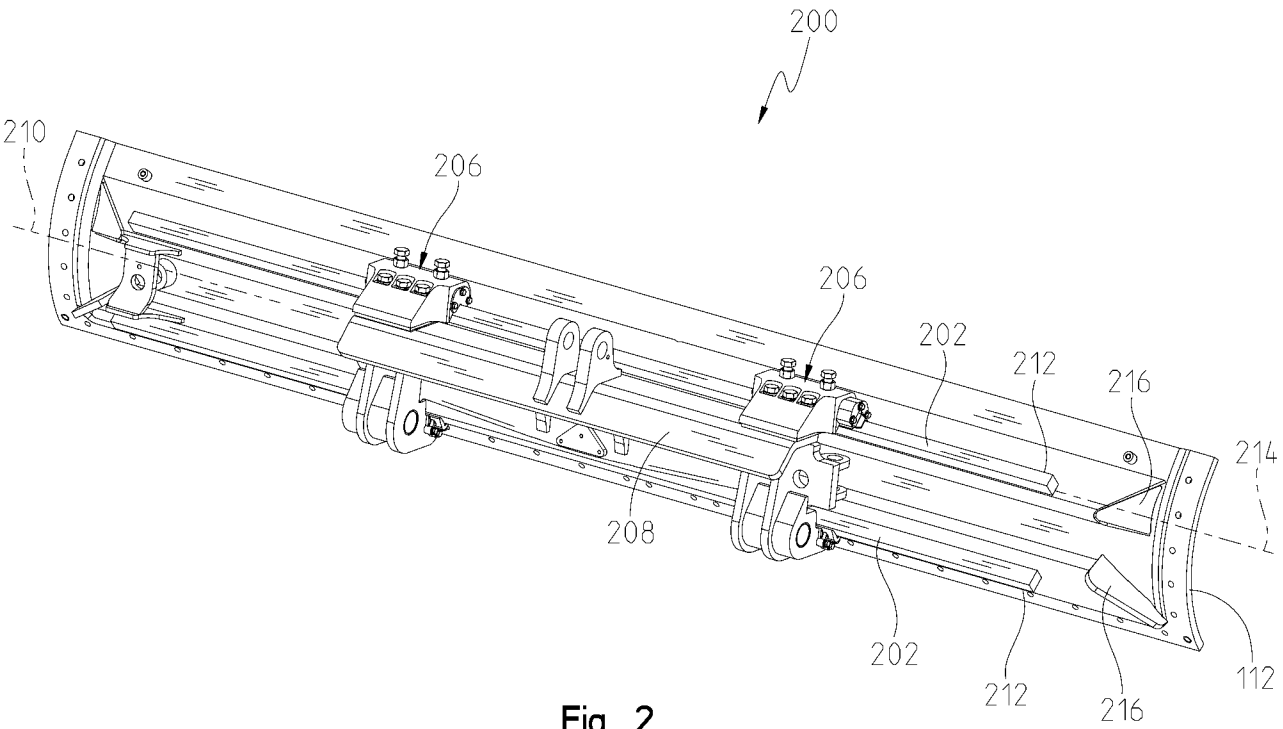
FIG. 2 is an isolated elevated perspective view of a moldboard assembly of the work machine of FIG. 1.

Referring now to FIG. 2, an isolated view of a moldboard assembly 200 is shown with portions of the work machine 100 removed. More specifically shown is at least one rail 202 mechanically coupled to the moldboard 112 via at least one moldboard coupler 216. In one nonexclusive embodiment, the rail 202 may have a square shaped cross-section and be coupled to the moldboard coupler 216 along one or more of the side surfaces of the respective rail 202. Further, the moldboard coupler 216 may be angled relative to the moldboard 112 to provide an angled offset of the respective rail 202. The angled offset of the respective rail 202 may provide an outermost edge 212 of the respective rail 202 relative to a moldboard axis 210. The outermost edge 212 may be a surface to slidably couple to at least one frame housing 206.

The frame housing 206 may be coupled to a tilt frame member 208 that is pivotally coupled to the chassis 102 on one end, and slideably coupled to the outermost edge 212 of the respective rail 202 on the other end. In this embodiment, the frame housing 206 may maintain the angular orientation of the moldboard 112 while simultaneously allowing the moldboard 112 to slide along a rail axis 214 via the respective rail 202.

Figure 3:
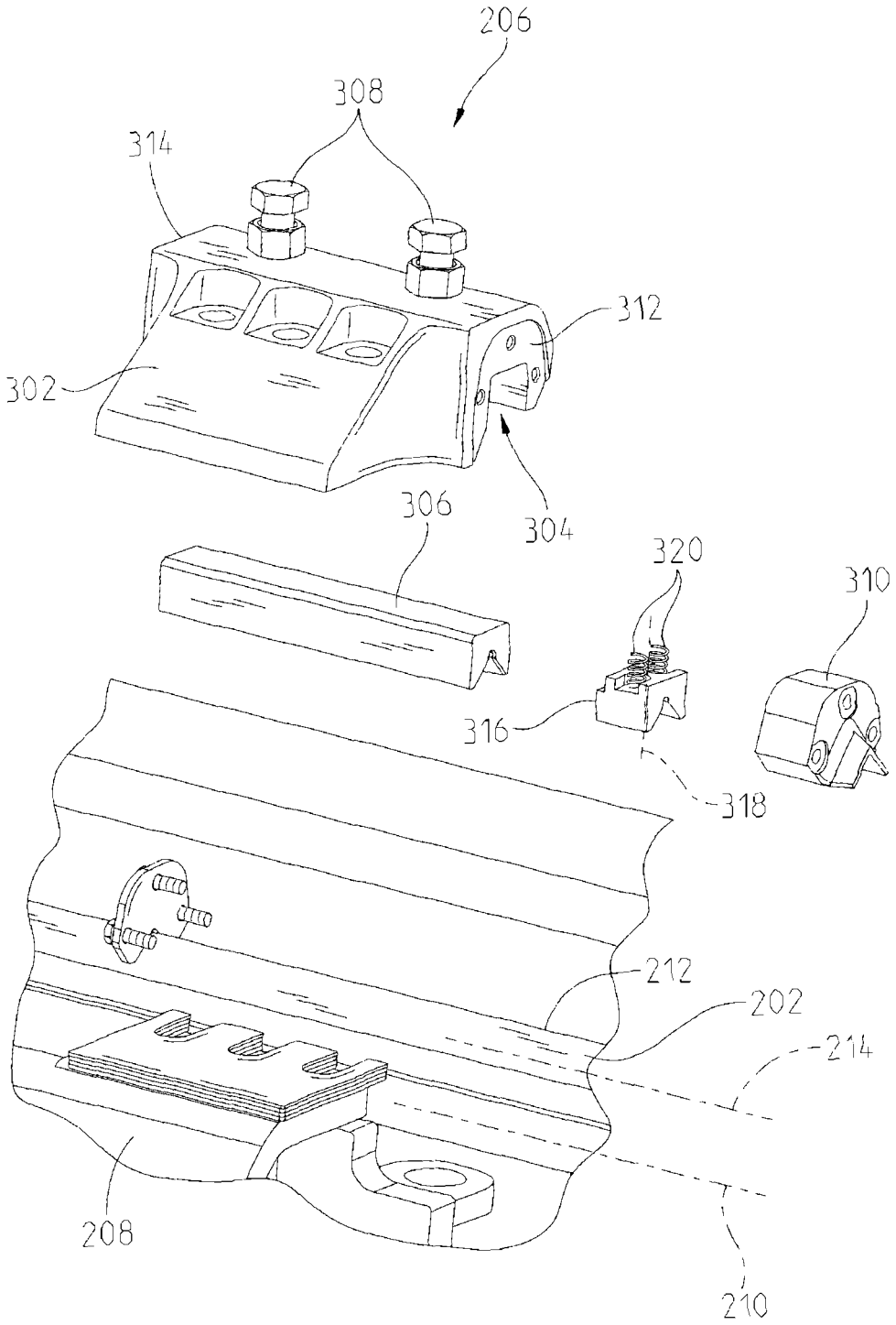
FIG. 3 is a section view of the moldboard assembly of FIG. 2 with the components of a tilt frame assembly shown in exploded form.

Now referring to FIG. 3, the components of the frame housing 206 are shown in an exploded view. More specifically, a frame mount 302 may provide a structural member for the remaining components of the frame housing 206. The frame mount 302 may be mechanically coupled to the tilt frame member 208 at a base end through one or more couplers. In one non-exclusive embodiment, the one or more couplers may be bolts that couple the frame mount 302 to the tilt frame member 208. In yet another embodiment, the frame mount 302 may be welded, riveted, clamped, or otherwise coupled to the tilt frame member 208 and this disclosure is not limited to any particular coupling method.

The frame mount 302 may extend away from the tilt frame member 208 and define a first cavity 304 within a portion of the frame mount 302 that is parallel to the rail axis 214 when the frame mount 302 is coupled to the tilt frame member 208. In one embodiment, the first cavity 304 maybe positioned along the frame mount 302 at a location aligned with the respective rail 202. In this embodiment, a wear insert 306 may be sized to correspond with the first cavity 304 to become disposed therein. The wear insert 306 may also be shaped to partially encompass and contact a portion of the outermost edge 212 of the respective rail 202. In one non-exclusive embodiment, the wear insert 306 may have a cross-section with a V-shaped channel. When the frame housing 206 is coupled to the tilt frame member 208 with the wear insert 306 positioned within the first cavity 304, the outermost edge 212 of the respective rail 202 may be positioned within the V-shaped channel. In this configuration, the rail 202 can slide along the wear insert 306 axially along the rail axis 214 while substantially maintaining the angular alignment of the moldboard 112 relative to the tilt frame member 208.

In another embodiment, the engagement between the wear insert 306 and the respective rail 202 may affect the accuracy in which the moldboard 112 may be maneuvered. Accordingly, the wear insert 306 may be adjustable within the first cavity through at least one adjusting mechanism 308. The adjusting mechanism 308 may provide a method for adjusting the location of the wear insert 306 within the first cavity 304. In one non-exclusive example, the adjustment mechanism 308 may be a screw that passes through a threaded passage (not shown) into a portion of the first cavity 304. The screw may be advanced through the threaded passage until it contacts a portion of the wear insert 306, thereby moving the wear insert closer to the respective rail 202. In this embodiment, the adjustment mechanism 308 allows the user to ensure the appropriate pressure is applied to the rail 202 through the wear insert 306.

The frame mount 302 may also provide a coupling location for a sub-housing 310. The sub-housing 310 may be removeably coupled to the frame mount 302 at a first side 312 and/or a second side 314 positioned along the rail axis 214. Further, the sub-housing 310 may partially define a second cavity 402 (FIG. 4) therein. The second cavity 402 may define an opening that faces the respective rail 202 when coupled to the frame mount 302. The second cavity 402 may also be sized to allow one or more wiper 316 to be positioned at least partially therein.

In the above embodiment, the wiper 316 may be positioned within the second cavity 402 such that the wiper 316 can slide axially along an apply axis 318. The apply axis 318 may be perpendicular to the respective rail axis 214 and the wiper 316 may travel towards, or away from, the outermost edge 212 of the respective rail 202 along the apply axis 318. In another embodiment, at least one spring 320 may be positioned in the second cavity 402 between the wiper 316 and the sub-housing 310. More specifically, the spring 320 may be positioned within the second cavity 402 to apply a biasing force to the wiper 316 along the apply axis 318 towards the respective rail 202. In this embodiment, the spring 320 may substantially maintain contact between the wiper 316 and the respective rail 202.

While at least one spring 320 has been described above, in another embodiment two springs 320 may be used. Further, the spring 320 may be a plurality of different types, and this disclosure is not limited to any one type. More specifically, the biasing force produced by the spring 320 may be produced through a coil spring, a hydraulic or pneumatic pressure between the wiper 316 and the sub-housing 310, a weight positioned to provide a force on the wiper 316 towards the rail 202, or any other similar device or method for providing a biasing force.

Similar to the wear insert 306, the wiper 316 may also have a cross section that defines a V-shaped channel that corresponds with the shape of the respective rail 202. The spring 320 may continuously force the wiper 316 onto the adjacent surface of the respective rail 202 along the outermost edge 212.

Figure 4:
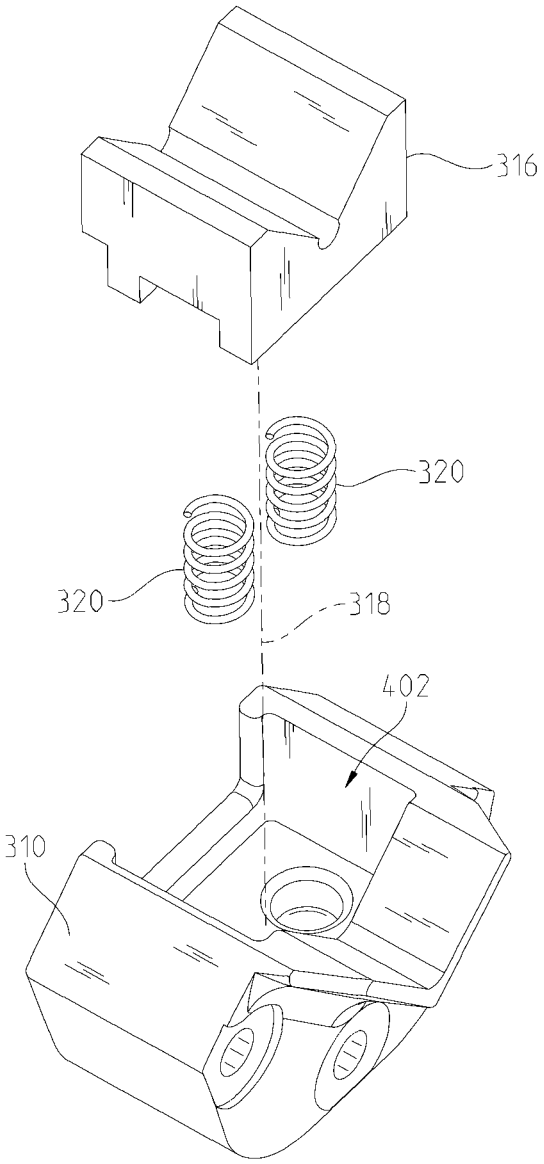
FIG. 4 is an isolated perspective view of a sub-housing and wiper from the tilt frame assembly of FIG. 3.

Referring now to FIG. 4, an isolated view of the sub-housing 310 is shown. The isolated view of the sub-housing 310 more clearly shows the second cavity 402 defined therein. More specifically, the second cavity 402 may restrict movement of the wiper 316 when it is positioned therein. Further, when the wiper 316 is positioned within the cavity, it may be substantially restricted from any movement except for moving axially along the apply axis 318.

Figure 5:
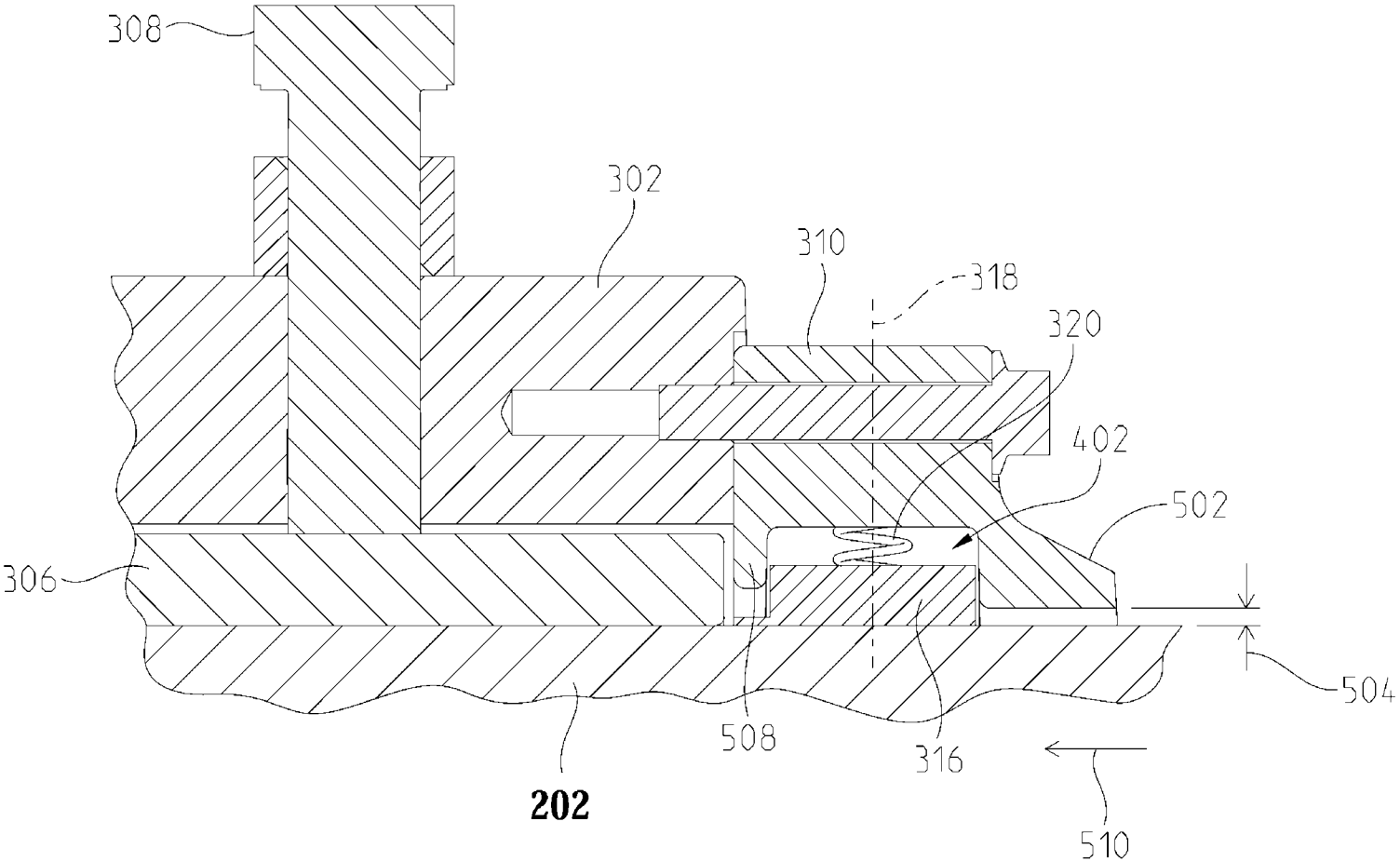
FIG. 5 is a sectional cross-section view of the tilt frame assembly of FIG. 3.

Now referring to FIG. 5, a cross-sectional view through the outermost edge 212 of the rail 202 is shown. As shown in FIG. 5, a ramped surface 502 may be defined at a terminus of the sub-housing 310. More specifically, as the ramped surface 502 extends away from the body of the sub-housing 310, it may be angled towards the rail 202. Further, the ramped surface 502 may allow a slight gap 504 between the ramped surface 502 and the respective rail 202 when the sub-housing 310 is coupled to the frame mount 302. The ramped surface 502 of the sub-housing 310 may be shaped to deflect any coarse debris disposed along the outermost edge 212 away from the respective rail 202.

In another embodiment, the ramped surface 502 may also have a leading nose (not particularly shown) that is axially farther from the sub-housing 310 than remaining portions of the ramped surface 502. In this embodiment, the ramped surface 502 may dispel coarse debris both away from the center of the rail 202 and off the sides of the rail 202.

A ridge 508 is also shown in FIG. 5. The ridge 508 may partially maintain both the wear insert 306 and the wiper 316 within their respective cavities 304, 402. In one non-exclusive example, when the sub-housing is coupled to the frame mount 302, the ridge 508 may substantially restrict the wear insert 306 from moving axially along the rail 202 relative to the frame mount 302. Similarly, the wiper 316 may be substantially restricted from moving axially towards the wear insert 306 by the ridge 508.

The adjustment mechanism 308 is more clearly shown in FIG. 5. In FIG. 5, the adjustment mechanism 308 is shown positioned through a portion of the frame mount 302 and contacting a portion of the wear insert 306 opposite the rail 202. If the adjustment mechanism 308 does not contact the wear insert 306, the wear insert 306 may allow the rail 202 to move the wear insert 306 relative to the frame mount 302. However, when the adjustment mechanism forces the wear insert 306 into contact with the rail 202, the rail 202 cannot move the rail insert 306 relative to the frame mount 302 and the rail 202 is held substantially in alignment with the frame mount 302.

Similarly, the relationship between the wiper 316, the sub housing 310, and the rail 202 is more clearly shown in FIG. 5. When the wiper 316 is disposed within the second cavity 402 between the sub-housing 310 and the rail 202, the spring 320 may force the wiper 316 along the apply axis 318 towards the rail 318. Unlike the wear insert 306, the wiper 306 may not require an adjustment mechanism other than the spring 320. More specifically, the spring 320 may provide a continuous force on the wiper 316 towards the rail 202 regardless of the position of the adjustment mechanism 308.

In another embodiment, the spring 320 may press the wiper 316 against the rail 202 with sufficient force to allow the wiper 316 to remove fine debris when the rail 202 slides therealong. In the nonexclusive example shown in FIG. 5, the rail 202 may be sliding in a first direction 510. As the rail 202 slides the first direction 510, any coarse debris disposed on the contact surface of the rail 202 may be scraped away from the rail 202 by the ramped surface 502 of the sub-housing 310. After the course debris is scraped off by the ramped surface 502, the rail 202 may slide in the first direction 510 under the wiper 316. The wiper 316 may be pressed against the surface of the rail 202 with sufficient force to substantially remove any fine debris that may have been positioned along the contact surface of the rail 202. Next, the rail 202 may proceed to slide along the wear insert 306 in the first direction 510. By the time the contact surface of the rail 202 slides along the wear insert 306, the coarse and fine debris has been substantially removed by the wiper 316 and the ramped surface 502. Accordingly, as the rail 202 slides along the wear insert 306, there may be substantially no debris disposed between the wear insert 306 and the contact surface of the rail 202.

While the above teachings have described a sub-housing assembly with a wiper at a specific location on the moldboard assembly 200, the teachings of this disclosure apply to any location along a rail that may require a cleaning function. More specifically, in another embodiment, a work machine may have a frame and an implement that can slide along an implement axis relative to the frame. The implement may have two rails coupled thereto. Each rail may be coupled to the frame, or to a sub-frame, through two different tilt frame mounts. Further, each tilt frame mount may have a sub-housing and wiper positioned on either side of the tilt frame mount along the respective rail. In this embodiment, the work machine may have four separate tilt frame mounts and eight separate sub-housings and wipers.

In another embodiment, positioning the sub-housing 310 and wiper 316 along the first side 312 and the second side 314 of the frame mount 302 may prevent debris from causing premature wear on the wear insert 306 and thereby reduce the frequency of adjustments. More specifically, if debris becomes positioned between the wear insert 306 and the rail 202 as the rail 202 moves axially along the rail axis 214, the debris may degrade the wear insert 306. By positioning the sub-housing 310 and wiper 316 at each the first side 312 and the second side 314 of each frame mount 302, both coarse debris and fine debris may be removed from the rail 202 prior to the rail 202 sliding along the wear insert 306 as described in more detail above. In this configuration, the wear insert 306 may be more resilient to wear as the rail 202 slides thereunder.

In another embodiment, the wiper 316 may apply a conditioner to the rail 202 as it cleans the fine debris therefrom. In one non-exclusive example, the wiper 316 may be composed of a material that conditions the rail 202 to slide more easily along the wear insert 306. The wiper 316 may be made of bronze, brass, Molybdenum disulfide-filled nylon, nylon 6/6, UHMW Polyethylene, aluminum-bronze, or any other similar material. However, other materials are also considered herein and this disclosure should not be limited to any one particular material for the wiper 316.

In yet another embodiment, the wiper 316 may have at least one striation positioned along a surface of the wiper 316 that contacts the rail 202. The striation may be a recessed portion of the wiper 316 that extends diagonally relative to the rail axis along the surface of the wiper 316. The striation may form an area along the surface that allows any fine debris encountered on the rail 202 to accumulate and be removed from the rail 202. While striations have been described above, many different formations within the surface of the wiper 316 are also considered herein. In one non-limiting example, channels, streaks, angled surfaces, and any other discontinuity may be defined along the surface of the wiper 316 to further facilitate the removal of debris.

In another embodiment of the present disclosure, the wiper 316 may be easily replaced. In this embodiment, the sub-housing 310 is removeably coupled to the frame mount 302 through one or more fasteners (not particularly shown). The one or more fasteners can be any type of fastener known in the art, and this disclosure is not limited to any one. As one non-exclusive example, the fasteners may be bolts that correspond with threaded receivers defined in the frame mount 302. In this configuration, the fasteners can be accessed and removed when the moldboard assembly 200 is fully assembled (i.e., the fasteners can be removed without removing any other components of the moldboard assembly 200). Once the fasteners are removed, the user may remove the sub-housing 310, the wiper 316, and the spring 320 from the frame mount 302.

The above embodiment may allow for substantially easy replacement and service of the wiper 316, spring 320, and/or sub-housing 310. The easy serviceability may result in shorter downtime of the work machine 100 due to repairs. Further, the durability of the wear insert 306 may be increased because the more easily replaced wiper 316 and sub-housing 310 remove the potentially damaging debris.

While the rail 202 is described and shown as having edges, the rail 202 can have a plurality of different cross-sectional shapes and this disclosure should not be limited to any one. More specifically, in another embodiment, the rail may be substantially cylindrical in shape with a circular cross-section. In yet another example, the rail may have a triangular cross section. A person skilled in the relevant art understands that many different rail shapes can incorporate the teachings of this disclosure.

In another non-exclusive embodiment, the wear insert may be integrally formed with the wiper. In this embodiment, there may not be a ridge 508 of the sub-housing 310 and the wear insert may extend into the second cavity 402. Further, the sub-housing 310 may have an opening instead of the ramped surface 502. Further still, the wear insert may extend partially through the opening and terminate at a ramped end as described above for the sub-housing 310.

In yet another embodiment, the wear insert could be chamfered on either end and extend slightly past ridge 508. This embodiment could also permit a gap in a mating recess of the wiper between the wiper and the wear insert to expel dirt. Further, the chamfered ends of the wear insert could expel away dirt disposed in the gap between the wear insert and the wiper.

While embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A moldboard rail cleaner for removing debris from a rail of a work machine, comprising:

a frame housing defining a first cavity;

a wear insert positioned within the first cavity and adapted to slide along the rail;

a sub-housing coupled to the frame housing and defining a second cavity; and a wiper disposed at least partially within the second cavity, the sub-housing configured to bias the wiper into contact with the rail;

wherein, the sub-housing comprises a lip that protrudes from the sub-housing, the lip sloping downwardly away from the sub-housing and towards the rail.

2. The moldboard rail cleaner of claim 1, wherein the wiper comprises a pair of angled corners at an end thereof opposite of where the sub-housing couples to the frame housing.

3. The moldboard rail cleaner of claim 1, further comprising at least one biasing element disposed between the sub-housing and the wiper, the biasing element configured to bias the wiper into contact with the rail.

4. The moldboard rail cleaner of claim 3, wherein the biasing element comprises one of a coil spring, a pneumatic pressure apparatus, a hydraulic pressure apparatus, or a weight.

5. The moldboard rail cleaner of claim 1, wherein the wear insert and the wiper are integrally formed from a single piece of material.

6. A moldboard assembly of a work machine, comprising:

a moldboard adapted to be coupled to the machine for performing a work function, the moldboard including at least one rail that defines a rail axis;

a frame housing coupled to the rail and defining a first cavity, a first side, and a second side;

a wear insert disposed within the first cavity and in contact with the rail;

a sub-housing coupled to the first side of the frame housing, the sub-housing defining a sub-housing cavity;

a lip integrally formed in the sub-housing and sloping away from the sub-housing and towards the at least one rail; and a wiper disposed at least partially within the sub-housing cavity, the wiper positioned in contact with the rail;

wherein, the wear insert, sub-housing, and wiper are positioned along the rail for removing debris and contaminants therefrom.

7. The moldboard assembly of claim 6, further comprising:

a second sub-housing coupled to the second side of the frame housing and defining a second sub-housing cavity;

a second wiper disposed at least partially within the second sub-housing cavity, the second wiper positioned in contact with the rail;

wherein, the second sub-housing and second wiper are movable along the rail for removing debris and contaminants therefrom.

8. The moldboard assembly of claim 6, further wherein the wear insert and the wiper are disposed in continuous contact with the rail.

9. The moldboard assembly of claim 6, further comprising an adjustment mechanism for selectively adjusting the distance between the wear insert and the rail.

10. The moldboard assembly of claim 6, further comprising at least one biasing element disposed between the sub-housing and the wiper, the biasing element configured to bias the wiper into contact with the rail.

11. A frame housing assembly for coupling a rail of a moldboard assembly, comprising:

a rail axis defined through the rail;

an apply axis defined perpendicular to the rail axis;

a frame mount defining a first cavity;

a wear insert sized to fit at least partially within the first cavity;

an adjusting mechanism coupled to the frame mount and configured to apply a first force on the wear insert along the apply axis;

a sub-housing coupled to an end of the frame mount and defining a second cavity;

a wiper sized to be positioned at least partially within the second cavity and movable about the apply axis;

a biasing member positioned between the wiper and the sub-housing and configured to apply a second force on the wiper along the apply axis;

wherein, the first force is independently adjustable relative to the second force.

12. The frame housing assembly of claim 11, wherein the wiper is formed of a bronze, brass, Molybdenum disulfide-filled nylon, nylon 6/6, UHMW Polyethylene, or aluminum-bronze and conditions the rail to reduce degradation of the wear insert.

13. The frame housing assembly of claim 11, further comprising a lip integrally formed within the sub-housing and protruding therefrom, the lip sloping away from the sub-housing along the rail axis.

14. The frame housing assembly of claim 13, wherein the lip, wiper, and wear insert each are configured to divert debris off a portion of the rail.

15. The frame housing assembly of claim 11, further comprising a ridge defined in the sub-housing, wherein the ridge prevents the wear insert from moving along the rail axis towards the wiper and prevents the wiper from moving along the rail axis towards the wear insert.

16. The frame housing assembly of claim 11, wherein the first force is adjustable by the adjustment mechanism and the second force consistently applied by the biasing member.

17. The frame housing assembly of claim 11, further comprising:

a ramped surface defined in the sub-housing; and a gap is defined between the ramped surface and the rail when the sub-housing is coupled to the frame mount;

wherein, the ramped surface is angled towards the rail, defined at a terminus of the sub-housing proximate to the rail, and extends away from the sub-housing.

18. The frame housing assembly of claim 11, wherein when the sub-housing is coupled to the frame mount, the wear insert and the wiper are restricted to the respective first and second cavity.

19. The frame housing assembly of claim 18, further wherein, when the sub-housing is removed from the frame mount, both the wear insert and the wiper are removeable from the respective first and second cavity.

* * * * *